US006943760B2

(12) United States Patent
Bae et al.

(10) Patent No.: US 6,943,760 B2
(45) Date of Patent: Sep. 13, 2005

(54) DRIVING IC OF AN ACTIVE MATRIX ELECTROLUMINESCENCE DEVICE

(75) Inventors: Sung Joon Bae, Songnam-shi (KR); Han Sang Lee, Seoul (KR); Joon Kyu Park, Seoul (KR)

(73) Assignee: LG. Philips LCD Co., Ltd., Seoul (KR)

( * ) Notice: Subject to any disclaimer, the term of this patent is extended or adjusted under 35 U.S.C. 154(b) by 423 days.

(21) Appl. No.: 10/015,767

(22) Filed: Dec. 17, 2001

(65) Prior Publication Data

US 2002/0075208 A1 Jun. 20, 2002

(30) Foreign Application Priority Data

Dec. 15, 2000 (KR) ..... 10-2000-77083
Dec. 23, 2000 (KR) ..... 10-2000-81415

(51) Int. Cl.[7] ..... G09G 3/30
(52) U.S. Cl. ..... 345/76; 315/169.3
(58) Field of Search ..... 345/76, 77, 78, 345/79, 80, 81; 315/169.3; 341/120, 144, 153

(56) References Cited

U.S. PATENT DOCUMENTS 6,052,074 A * 4/2000 Iida ..... 341/144
6,556,176 B1 * 4/2003 Okuyama et al. ..... 345/76

* cited by examiner

*Primary Examiner*—Chanh Nguyen
(74) *Attorney, Agent, or Firm*—McKenna Long & Aldridge LLP

(57) ABSTRACT

A driving circuit for an active matrix electroluminescence device (AMELD) can control an output current value according to R/G/B channels by receiving a digital signal of n bits. In the driving circuit of the AMELD having data and gate drivers that respectively transmit a data signal and a scan signal to each pixel region, the data driver includes a latch for latching a control signal temporarily stored, and a plurality of digital to analog converters (DAC) for outputting a reference current of a certain level as a data signal according to R/G/B channels is latched by the control signal.

36 Claims, 9 Drawing Sheets

DRIVING IC OF AN ACTIVE MATRIX ELECTROLUMINESCENCE DEVICE

This application claims the benefit of the Korean Application No. P2000-077083 filed on Dec. 15, 2000, which is hereby incorporated by reference as if fully set forth herein.

BACKGROUND OF THE INVENTION

1. Field of the Invention

The present invention relates to a driving circuit of a display device, and more particularly, to a driving circuit of an active matrix electroluminescence device (AMELD) driven by digital signals.

2. Discussion of the Related Art

An AMELD emits light by electroluminescence. The AMELD is manufactured by forming electrodes of matrix type at both surfaces of a flat shaped luminescent layer. The AMELD includes a picture display unit and a driving circuit unit.

The AMELD has characteristics such as wide viewing angle, rapid response time, high contrast, low voltage driving, low power consumption, thinness and lightness in weight. Furthermore, the AMELD can display various colors, so that the AMELD has been attractive as a new generation display device for use in a large sized flat display device.

Display devices have several intermediate states, which range from black and white states to display various colors. At this time, methods for displaying colors are classified in two categories: (1) to adjust voltage intensity applied to a liquid crystal and (2) to adjust current intensity applied to the liquid crystal.

The method for adjusting the voltage intensity applied to the liquid crystal is based on a characteristic in which transmittivity of light varies according to the voltage intensity. That is, picture luminance is changed according to a data voltage with respect to a threshold voltage by adjusting the intensity of an externally applied voltage.

At this time, the threshold voltage is the voltage at which a change of the transmittivity begins occur after a voltage is first applied, i.e. the threshold voltage is the gate voltage needed to establish a conducting channel between the source and drain of an enhancement MOS or PN Diode. If the threshold voltage is high, the voltage intensity applied to the liquid crystal must be increased, thereby increasing power consumption.

The transmittivity is proportional to the voltage intensity according to a curve function. In this case, it is hard to adjust the voltage intensity according to the transmittivity.

To obtain picture images in a display panel, several blocks are set to display gray so that transmittivity is changed according to the voltage intensity applied. At this time, if the blocks are set according to the voltage intensity, intervals of the transmittivity are not constant because the transmittivity is proportional to the voltage intensity in the curved function. Therefore, it is difficult to display gray and to obtain uniformity of the picture images.

Meanwhile, the transmittivity is proportional to the current intensity in a straight line. Therefore, to adjust the current intensity is easier and more accurate than to adjust the voltage intensity.

A driving circuit of a general AMELD will be described with reference to the accompanying drawings.

FIG. 1 is a schematic view showing a structure of the driving circuit of the general AMELD.

As shown in FIG. 1, the driving circuit of the general AMELD includes a power supply 10, an interface unit 11, a memory unit 12, a source driver 15, a gate driver 16 and a timing controller 47.

The power supply 10 supplies power to a display panel. The interface unit 11 transfers an image signal from an external micro controller. The memory unit 12 stores the image signal from the interface unit 11. The source driver 15 outputs the power supplied from the power supply 10 to a data signal of a display panel. Also, the gate driver 16 outputs a scan signal turning on a TFT to apply the data signal to each pixel of the display panel 18. The timing controller 17 generates and controls timing signals required to the source and gate drivers.

The signal source is a computer or a laser disk player for displaying moving pictures.

SUMMARY OF THE INVENTION

Accordingly, the present invention is directed to a driving circuit of an active matrix electroluminescence device (AMELD) that substantially obviates one or more problems due to limitations and disadvantages of the related art.

An advantage of the present invention is to provide a driving circuit of an AMELD that can control an output current value according to red, green and blue (R/G/B) channels by receiving a digital signal of n bits, thereby improving packing density of an integrated circuit (IC) for driving current.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these advantages and other advantages and in accordance with the purpose of the invention, as embodied and broadly described herein, in a driving circuit of an AMELD having data and gate drivers that respectively transmit a data signal and a scan signal to each pixel region, the data driver includes a latch latching a control signal temporarily stored, and a plurality of digital to analog converters (DAC) outputting a reference current of a certain level as a data signal according to R/G/B channels by the control signal latched.

That is, n number of reference current values temporarily set are selectively turned on according to digital signals of n bits for displaying gray desired. Also, two voltage terminals are formed, in which one has a constant voltage value, and the other has a voltage value that is changed according to R/G/B channels. Therefore, it is possible to adjust output voltage terminal according to R/G/B colors.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE ILLUSTRATED EMBODIMENTS

Reference will now be made in detail to the illustrated embodiments of the present invention, examples of which are illustrated in the accompanying drawings. Wherever possible, the same reference numbers will be used throughout the drawings to refer to the same or like parts.

A driving circuit in an AMELD according to the embodiments of the present invention will be described with the accompanying drawings.

Figure 1:
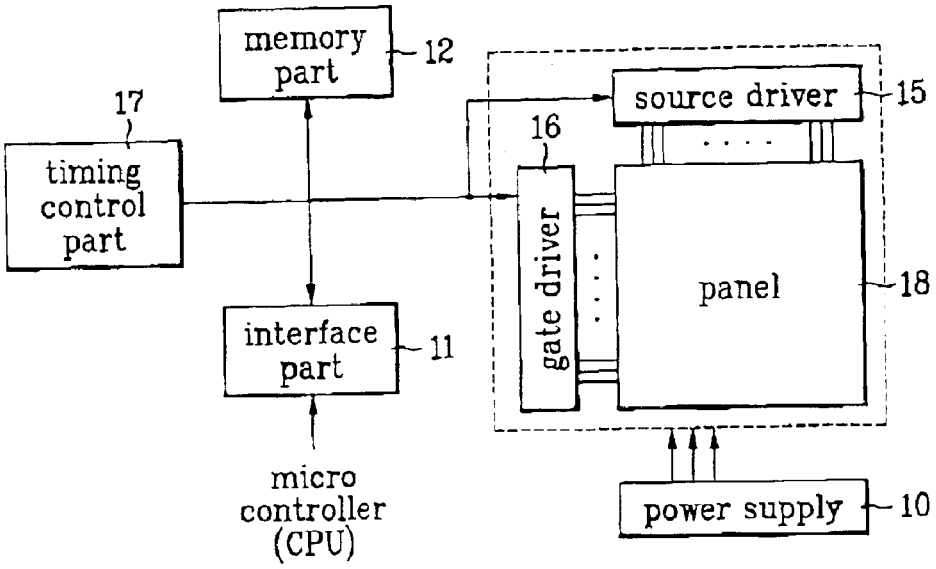
FIG. 1 Related Art
FIG. 1 illustrates a schematic view showing a structure of a driving circuit in a general AMELD.
Figure 2:
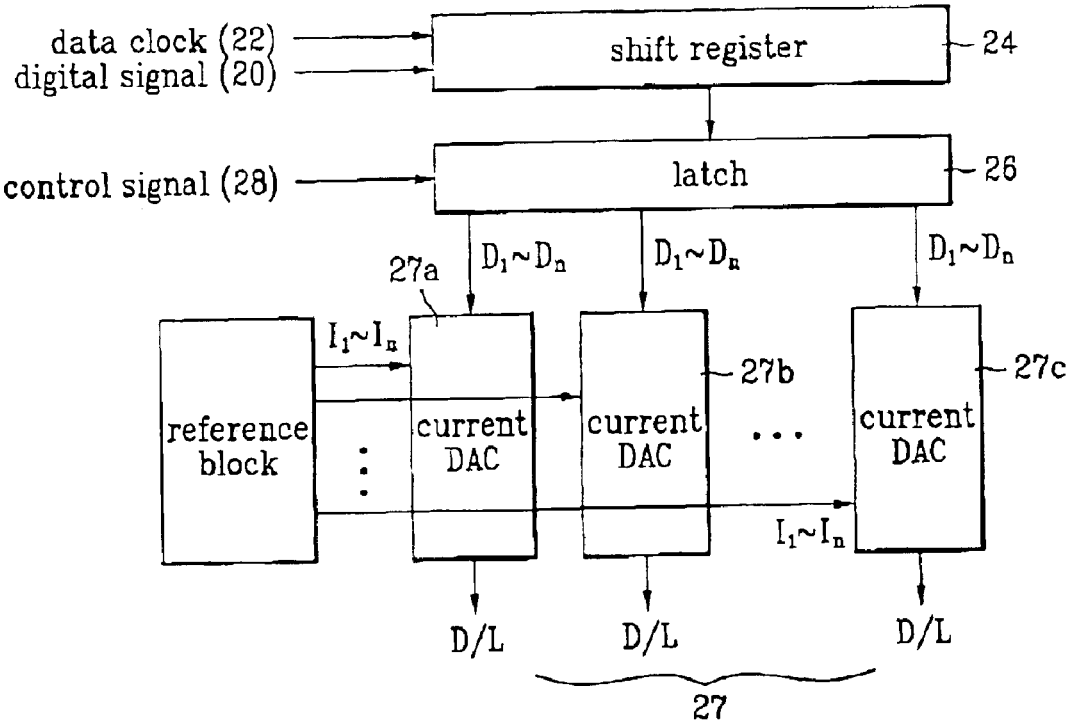
FIG. 2 illustrates a structure view of a data driving circuit in a general AMELD.

FIG. 2 shows a structure of a data driver in a general AMELD.

As shown in FIG. 2, the data driver of the AMELD includes a shift register 24, a latch 26 and a digital-analog converter DAC 27.

Digital signals 20 of R/G/B (red/green/blue) channels input from external source according to a data clock 22 are temporarily stored in a shift register 24. Then, the latch 26 latches the digital signals 20 of the R/G/B channels applied from the shift register 24 according to control signals 28. The digital signals 20 of the R/G/B channels latched from the latch 26 are applied to the DAC. Then the DAC 27 converts the digital signals $D_1$ to $D_n$ of the R/G/B channels to analog signals.

At this time, the DAC 27 includes a plurality of current DACs 27*a*, 27*b*, 27*c*. In each current DAC 27*a*, 27*b*, 27*c*, the digital signals $D_1$ to $D_n$ of the R/G/B channels are temporarily combined by a plurality reference current sources $I_1$ to $I_n$ that serve as control signals of a plurality of switching devices. Then a certain sink current is output to a data line connected to a pixel by outputting a current of a certain level.

First and Second Embodiments

Figure 3:
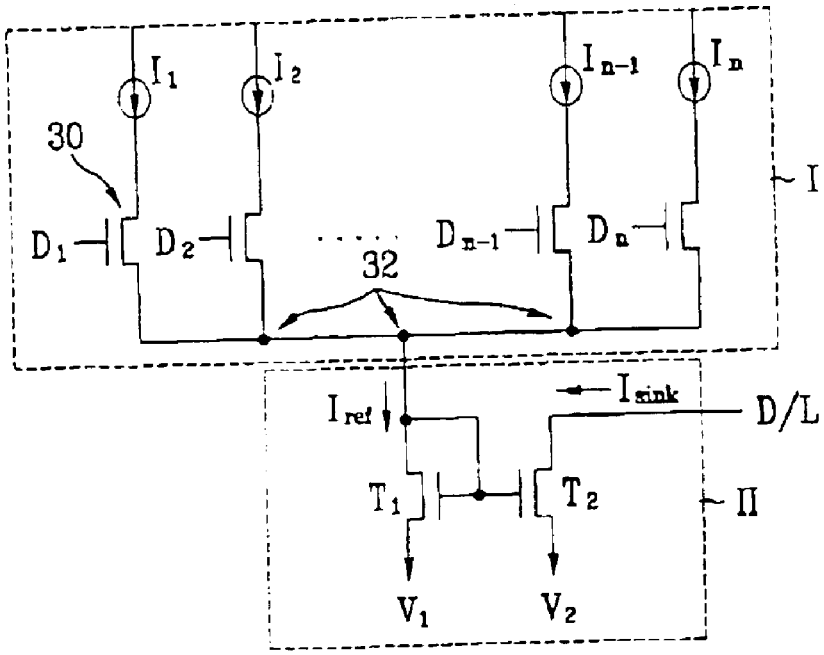
FIG. 3 illustrates a circuit diagram of a driving circuit in an AMELD according to a first embodiment of the present invention.
Figure 4:
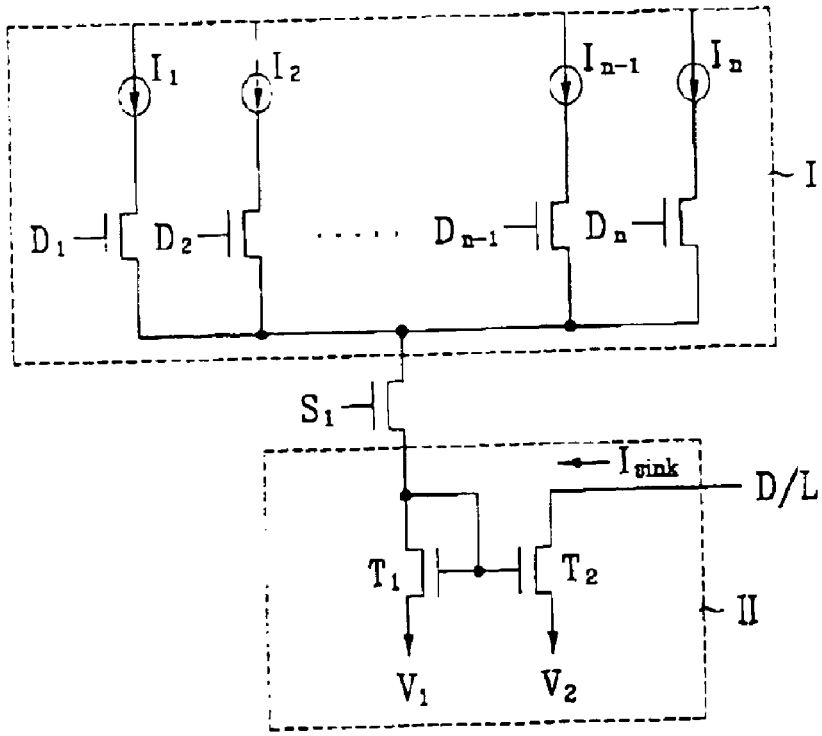
FIG. 4 illustrates a circuit diagram of a driving circuit in an AMELD according to a second embodiment of the present invention.

FIG. 3 illustrates a circuit diagram of a driving circuit in an AMELD according to the first embodiment of the present invention. FIG. 4 illustrates a circuit diagram of a driving circuit in an AMELD according to the second embodiment of the present invention.

In the driving circuit of the AMELD according to the first embodiment of the present invention, the driving circuit includes a reference current output unit I and a sink current controller II.

In the reference current output unit I, a plurality reference current sources $I_1$ to $I_n$ are temporarily combined, and then a reference current $I_{ref}$ of a certain level is output. In the sink current controller II, a level of a sink current can be controlled by receiving the reference current Iref of the certain level output from the reference current output unit.

The reference current output unit I includes a plurality of switching devices 30. Various currents $I_1$ to $I_n$ of different levels are applied to input terminals of the switching devices 30. Output terminals of the switching device 30 are connected to one another. An output level in the output terminals 32, which are connected to one another, is determined by control signals $D_1$ to $D_n$.

In the present embodiment, the switching device is a TFT.

The sink current controller II includes a first voltage terminal $V_1$, a second voltage terminal $V_2$ and a plurality of transistors $T_n$ of current mirror type. A first transistor $T_1$ is connected between the first voltage terminal $V_1$ and the output terminal of the reference current output unit I. A second transistor $T_2$ is connected with the second voltage terminal $V_2$ and a data line. Gates of the first and second transistors $T_1$ and $T_2$ are connected to the output terminal of the reference current output unit I.

In the digital driving circuit, the first voltage terminal $V_1$ is set at a constant value, such as a ground voltage. Alternatively, a positive voltage or a negative voltage can be used as a value of the first voltage terminal $V_1$. Meanwhile, a certain voltage value is respectively applied to the second voltage terminal $V_2$ according to the R/G/B channels. In this case, if a voltage level is controlled, a level of the sink current can be increased or decreased, so that a certain voltage level is transmitted to the data line D/L.

At this time, levels of the reference current $I_1$ to $I_n$ can be set temporarily like binary weight. That is, the level of the voltage is set so that an equation: $I_n=2I_{n-1}=2^2I_{n-2}= \ldots = 2^{n-2}I_2=2^{n-1}I_1$ is satisfied. Or, the level of the reference voltage can be set in a gamma correction method.

The $D_1$ to $D_n$ that serve as control signals are digital input signals of n bits, which are converted corresponding to input analog signals.

Meanwhile, as shown in FIG. 4, a driving circuit according to the second embodiment of the present invention includes further a current breaking switch $S_1$ between the output terminal of the reference current output unit I and the input terminal of the first transistor $T_1$ of the first embodiment of the present invention.

Third and Fourth Embodiments

Figure 5:
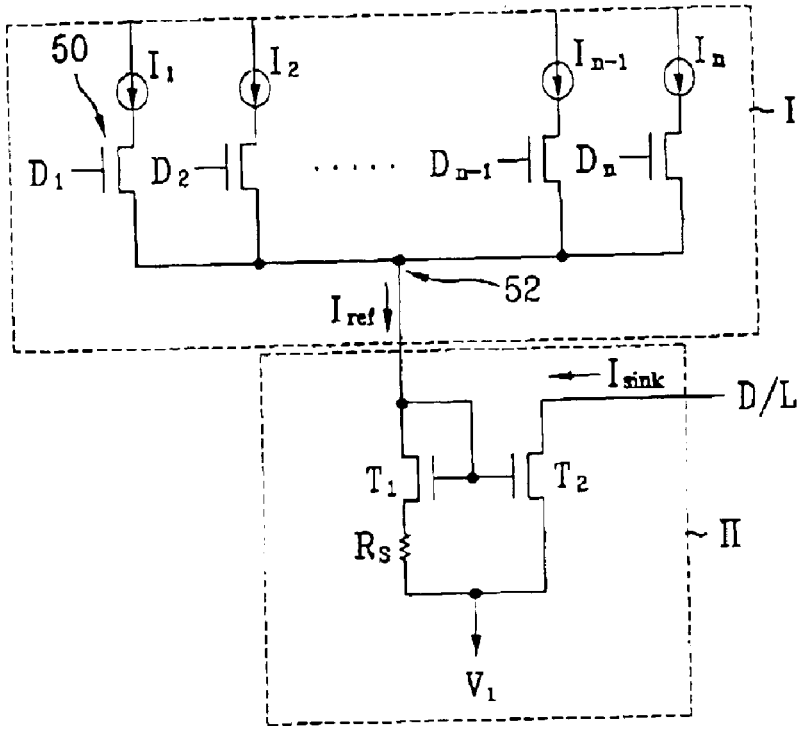
FIG. 5 illustrates a circuit diagram of a driving circuit in an AMELD according to a third embodiment of the present invention.
Figure 6:
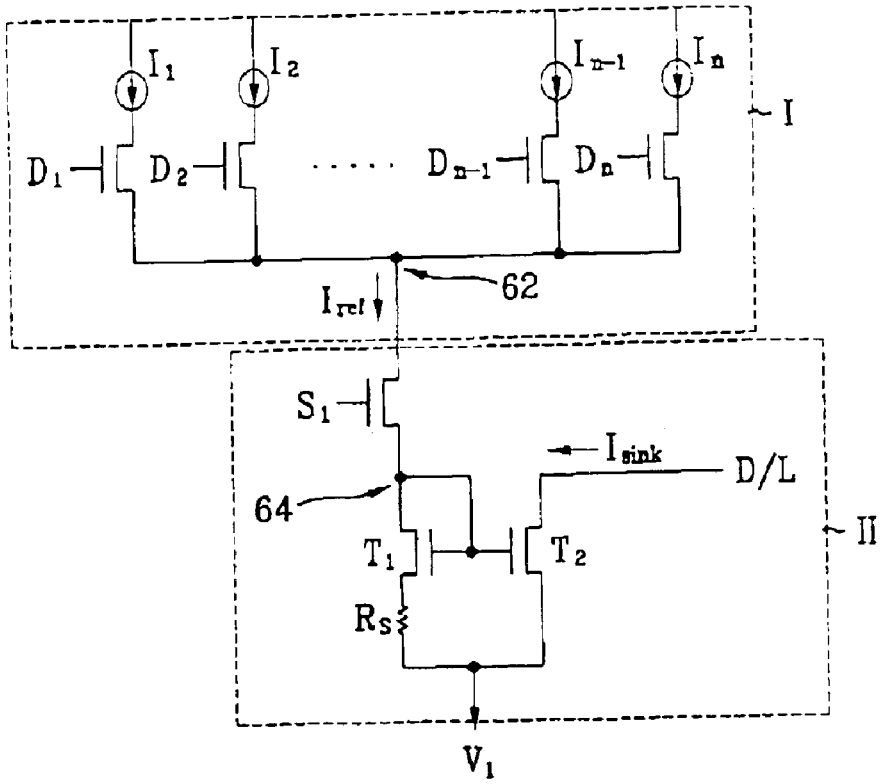
FIG. 6 illustrates a circuit diagram of a driving circuit in an AMELD according to a fourth embodiment of the present invention.

FIG. 5 illustrates a circuit diagram of a driving circuit of an AMELD according to the third embodiment of the present invention. FIG. 6 illustrates a circuit diagram of a driving circuit of an AMELD according to the fourth embodiment of the present invention.

A driving circuit of the AMELD according to the third embodiment of the present invention includes a reference current output unit I and a sink current controller II.

The reference current output unit I includes a plurality of switching devices 50. Various currents $I_1$ to $I_n$ of different levels are applied to input terminals of the switching devices, and output terminals of the currents are connected to one another. An output level in the output terminals 52, which are connected to one another, is determined by control signals $D_1$ to $D_n$.

In the present embodiment, the switching device is a TFT.

The sink current controller II includes a first voltage terminal $V_1$, a first transistor $T_1$, a fixed resistance $R_s$ and a second transistor $T_2$. The first transistor $T_1$ and the fixed resistance $R_s$ are connected in series between the first voltage terminal $V_1$ and the output terminal 52 of the reference current output unit I. Also, the second transistor $T_2$ is connected in series between a data line D/L and the first voltage terminal $V_1$. Gates of the first and second transistors are connected with the output terminal 52 of the reference current output unit I.

That is, the reference currents $I_1$ to $I_n$ of different levels are applied and are selectively controlled and combined. Then, a reference current of a certain level is output from the reference current output unit I. The reference current of a certain level is input to gates of the first and second transistors $T_1$, $T_2$ so that a voltage applied from the first voltage terminal $V_1$ can be controlled. Therefore, a value of a sink current $I_{sink}$ from the data line D/L can be controlled. At this time, the voltage applied to the first voltage terminal is set any one of a ground voltage, a positive voltage and a negative voltage.

The resistance $R_s$ is set so different levels according to the voltages of each of the R/G/B channels, thereby driving each R, G or B channel.

That is, even though the reference current $I_{ref}$ is constantly outputted from the reference current output unit I, the value of the sink current $I_{sink}$ according to each color can be controlled by varying the fixed resistance $R_s$. Therefore, it is possible to obtain integration of the driving circuit in the AMELD.

In the present embodiment, the level of the reference current source is set temporarily. For examples, the voltage level $V_1$ is set so that an equation $I_n=2I_{n-1}=2^2I_{n-2}= \ldots = 2^{n-2}I_2=2^{n-1}I_1$ is satisfied.

Meanwhile, as shown in FIG. 6, a driving circuit according to the fourth embodiment of the present invention includes further a current breaking switch $S_1$ between the output terminal 62 of the reference current output unit I and the input terminal 64 of the first transistor $T_1$ of the third embodiment of the present invention.

Fifth and Eighth Embodiments

Figure 7:
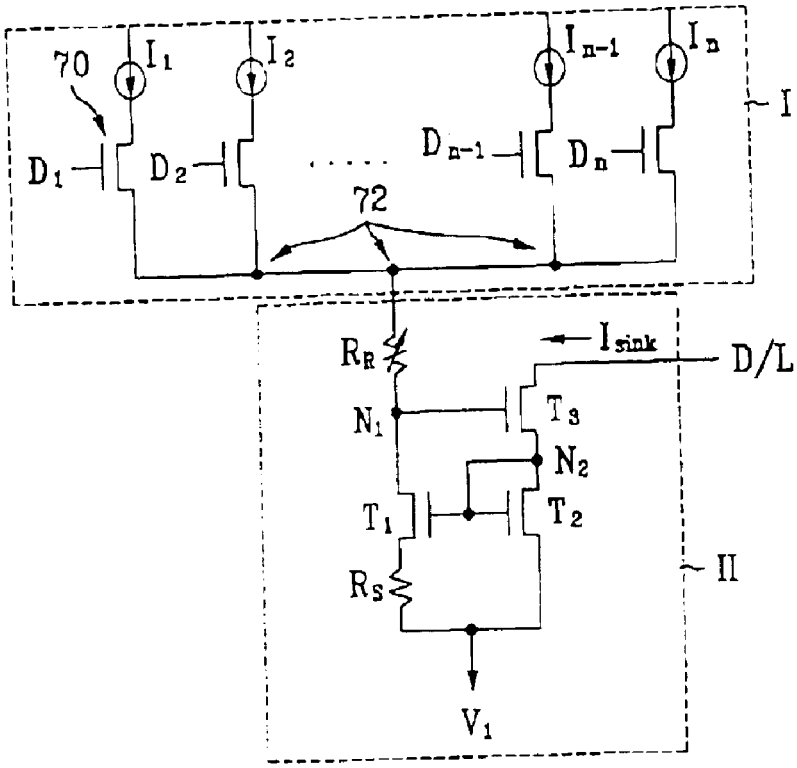
FIG. 7 illustrates a circuit diagram of a driving circuit in an AMELD according to a fifth embodiment of the present invention.

FIG. 7 illustrates a circuit diagram of a driving circuit in an AMELD according to the fifth embodiment of the present invention.

As shown in FIG. 7, the driving circuit of the AMELD includes a reference current output unit I and a sink current controller II.

The reference current output unit I includes a plurality of switching devices 70. Various currents $I_1 \ldots I_n$ of different levels are applied to input terminals of the switching devices 70. Then an output level in output terminals 72, which are connected to one another, is determined by control signals $D_1$ to $D_n$.

In the present embodiment, the switching device is a thin film transistor (TFT).

The sink current controller II includes a first voltage terminal $V_1$, a variable resistance $R_R$, a first transistor $T_1$, a fixed resistance $R_s$, a second transistor $T_2$, and a third transistor $T_3$. The transistors $T_1$, $T_2$ and $T_3$, are, for example, thin film transistors. At this time, the variable resistance $R_R$ is connected in series between the first voltage terminal $V_1$ and the output terminal 72 of the reference current output unit I. The second transistor $T_2$ and the third transistor $T_3$ are connected between a data line D/L and the first voltage terminal $V_1$. A gate of the third transistor $T_3$ is connected between the variable resistance $R_R$ and a first node $N_1$ connected to a drain of the first transistor. Gates of the first and second transistors $T_1$, $T_2$ are connected with a source of the second transistor $T_2$ and a second node $N_2$ connected to a drain of the third transistor $T_3$.

The variable resistance $R_R$ value is adjusted to keep all of $T_1$, $T_2$, $T_3$ having an equal characteristic in a panel when a data voltage is applied from the reference current output unit.

The first and third transistors $T_1$, $T_3$ include a current repeater, so that an amount of current that flows from the data line to the first voltage terminal varies according to an amount of current provided to the first node $N_1$. That is, a reverse current that flows through the second and third transistors $T_2$, $T_3$ from the data line D/L to the first voltage terminal $V_1$ varies according to the voltage of the reference current output unit I.

The first and second transistors $T_1$, $T_2$ are formed in a current mirror, so that an amount of current that is provided from the data line D/L to the first voltage terminal $V_1$ is determined by an amount of current that flows in the third transistor $T_3$.

A value of the fixed resistance $R_s$ is determined according to R/G/B channels. That is, in case that an equal pixel voltage is applied, the amount of current that flows from the data line D/L to the first voltage terminal $V_1$ is determined according to a resistance value of the fixed resistance $R_s$.

Figure 10:
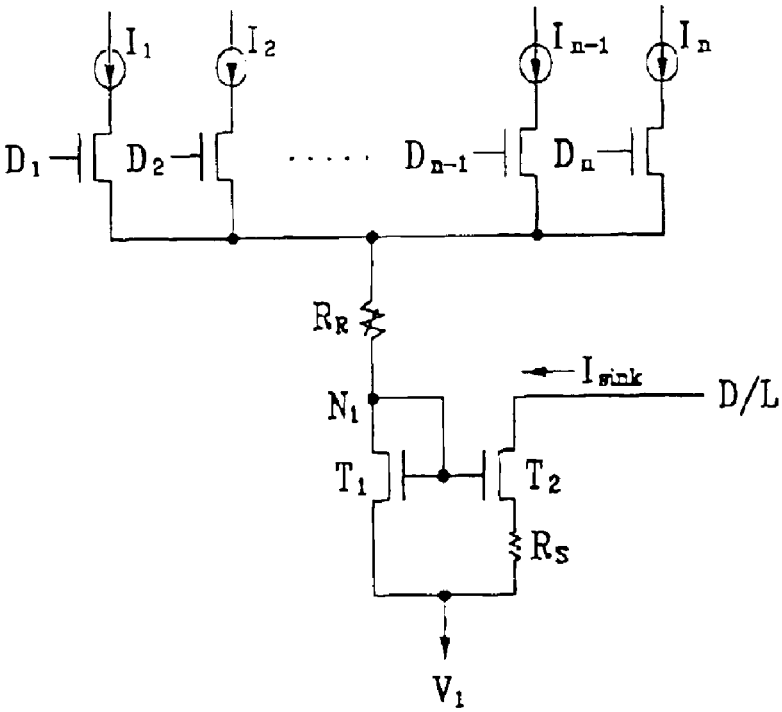
FIG. 10 illustrates a circuit diagram of a driving circuit in an AMELD according to an eighth embodiment of the present invention.

As shown in FIG. 10 illustrating the eighth embodiment, the fixed resistance may be connected between the second transistor $T_2$ and the first voltage terminal $V_1$.

The fixed resistance controls the voltage applied from the first voltage terminal $V_1$, thereby controlling a sink current $I_{sink}$ value from the data line D/L. The voltage applied to the first voltage terminal $V_1$ is set any one of a ground voltage, a positive voltage and a negative voltage.

That is, a reference current of a certain level output from the reference current output unit can control an output sink current value according to each R/G/B color. Therefore, it is possible to obtain integration of the driving circuit in the AMELD.

Also, a luminance of a panel can be adjusted by controlling the variable resistance.

Sixth and Seventh Embodiments

Figure 8:
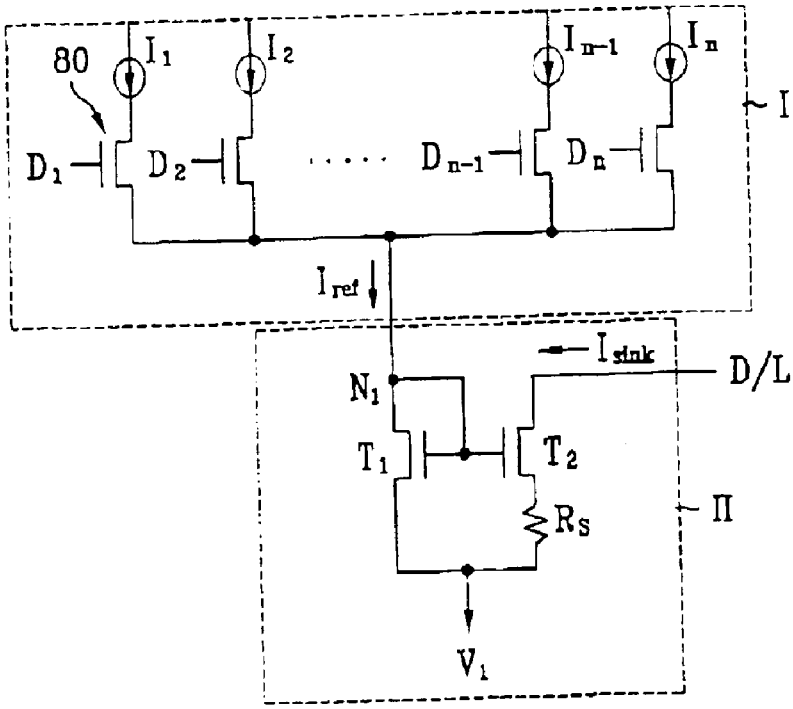
FIG. 8 illustrates a circuit diagram of a driving circuit in an AMELD according to a sixth embodiment of the present invention.
Figure 9:
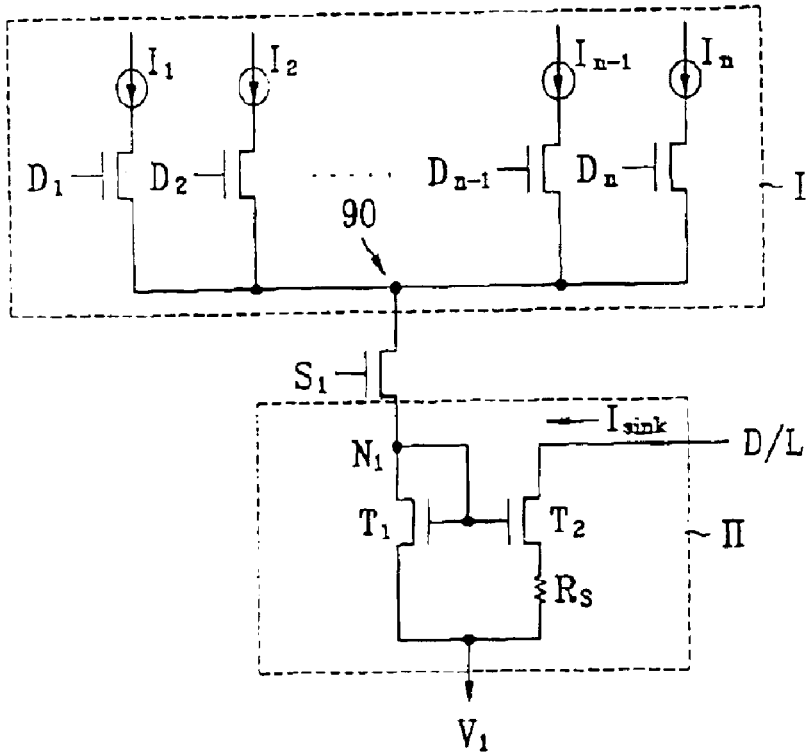
FIG. 9 illustrates a circuit diagram of a driving circuit in an AMELD according to a seventh embodiment of the present invention.

FIG. 8 is a circuit diagram of a driving circuit in an AMELD according to the sixth embodiment of the present invention. FIG. 9 is a circuit diagram of a driving circuit in an AMELD according to the seventh embodiment of the present invention.

As shown in FIG. 8, the driving circuit of the AMELD according to the present invention includes a reference current output unit I outputting a reference current $I_{ref}$ of a certain level, and a sink current controller II controlling a level of a sink current $I_{sink}$.

The reference current output unit I includes n number of switching devices 80. Various currents of different levels are applied to input terminals of the switching devices, and then reference currents $I_1 \ldots I_n$ are combined by control signals $D_1$ to $D_n$ of n bits, so that a certain output level is determined.

In the present embodiment, the switching device is a TFT.

The sink current controller II includes a first voltage terminal $V_1$, a fixed resistance $R_s$, a first transistor $T_1$ and a second transistor $T_2$. At this time, the first transistor $T_1$ is connected in series between the first voltage terminal $V_1$ and the output terminal of the reference current output unit I. The second transistor $T_2$ is connected with the fixed resistance $R_s$ in series between a data line D/L and the first voltage terminal $V_1$. Gates of the first and second transistors $T_1$ and $T_2$ are connected with the output terminal 82 of the reference current output unit I.

The fixed resistance $R_s$ is directly connected to the first voltage terminal $V_1$. The first voltage terminal $V_1$ is set to be a constant voltage, and a sink current can be controlled according to each R/G/B channel by the fixed resistance $R_s$, which can be varied in value according to each R/G/B channel.

In the reference current output unit I, the n number of reference current sources are selectively combined by control signals $D_1$ to $D_n$ of n bits, and then are output, thereby obtaining intermediate gray desired among R, G and B colors.

For example, if a driving circuit of 6 bits is used, 64 grays can be obtained. Also, if 256 grays are obtained in a full color monitor, at least sixteen million colors can be obtained.

As shown in FIG. 9, a driving circuit according to the seventh embodiment of the present invention includes further a current breaking switch $S_1$ between the output terminal 90 of the reference current output unit I and the input terminal $N_1$ of the first transistor $T_1$ of the sixth embodiment of the present invention.

Ninth, Tenth, Eleventh, Twelfth and Thirteenth Embodiments

Figure 11:
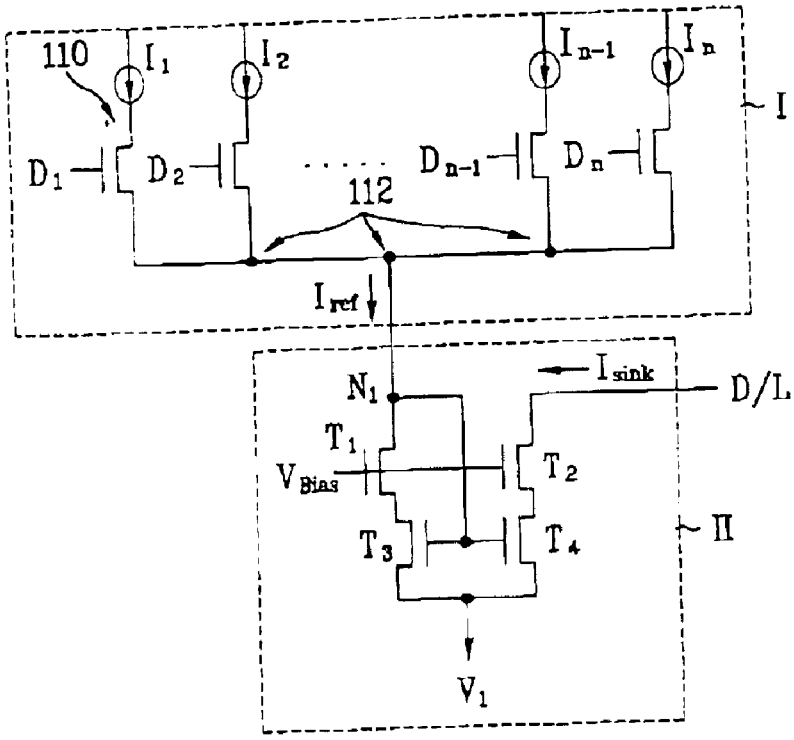
FIG. 11 illustrates a circuit diagram of a driving circuit in an AMELD according to a ninth embodiment of the present invention.
Figure 12:
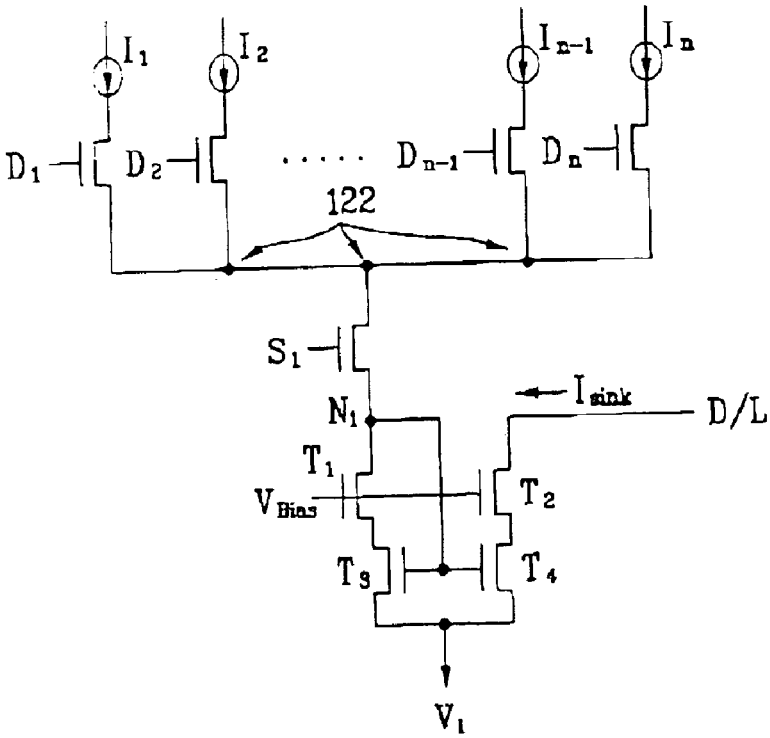
FIG. 12 illustrates a circuit diagram of a driving circuit in an AMELD according to a tenth embodiment of the present invention.

FIG. 11 is a circuit diagram of a driving circuit of an AMELD according to the ninth embodiment of the present invention. FIG. 12 is a circuit diagram of a driving circuit of an AMELD according to the tenth embodiment of the present invention.

As shown in FIG. 11, the AMELD according to the ninth embodiment of the present invention includes a reference current output unit I and a sink current controller II. In the sink current controller II, a level of a sink current $I_{sink}$ can be controlled by receiving the reference current output $I_{ref}$ from the reference current output unit I.

At this time, the reference current output unit I includes a plurality of switching devices 110. Various currents $I_1 \ldots I_n$ of different levels are applied to input terminals of the switching devices 110. Then an output level is determined in output terminals 112 connected to one another by control signals $D_1$ to $D_n$.

In the present embodiment, the switching device is a TFT.

The sink current controller II includes a first voltage terminal $V_1$, and first, second, third and fourth transistors $T_1$, $T_2$, $T_3$ and $T_4$.

The first and third transistors $T_1$ and $T_3$ are connected in series between the output terminal 112 of the reference current output unit I and the first voltage terminal $V_1$. The second and fourth transistors $T_2$ and $T_4$ are connected in series between the first voltage terminal $V_1$ and a data line D/L.

At this time, gates of the third and fourth transistors $T_3$, $T_4$ are connected to the output terminal 112 of the reference current output unit I, i.e., at a first node $N_1$. Gates of the first and second transistors $T_1$, $T_2$ are connected to an external bias voltage $V_{Bias}$ which is controlled at a certain voltage.

The $V_{Bias}$ is usually set at about 3.3V.

The voltage at the first voltage terminal $V_1$ is a voltage applied externally to control the level of the sink current $I_{sink}$ output according to R/G/B channels.

Meanwhile, as shown in FIG. 12, a driving circuit according to the tenth embodiment of the present invention includes further a current breaking switch $S_1$ between the output terminal 122 of the reference current output unit I and the first node $N_1$ of the ninth embodiment.

Figure 13:
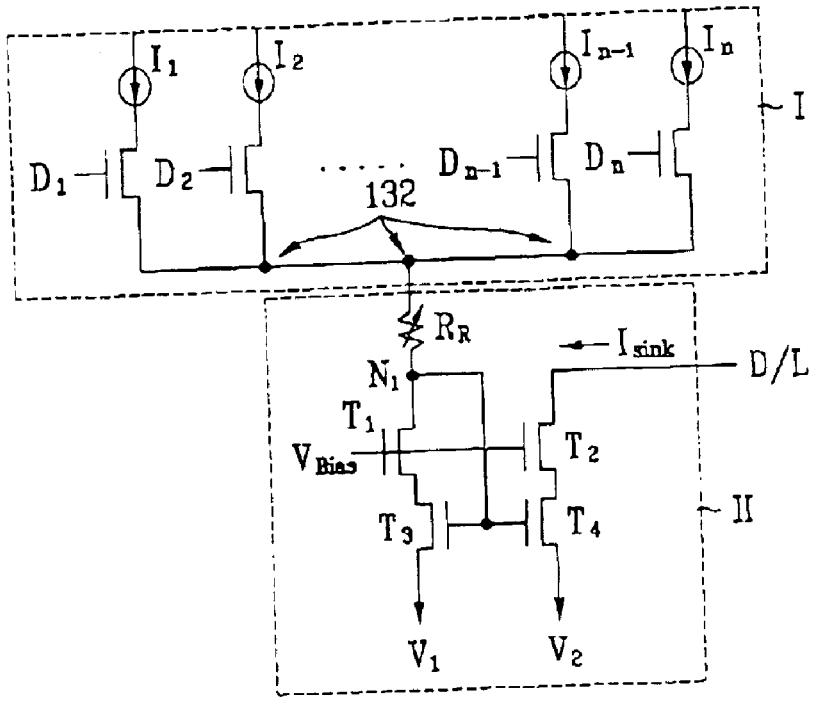
FIG. 13 illustrates a circuit diagram of a driving circuit in an AMELD according to an eleventh embodiment of the present invention.

As shown in FIG. 13, a driving circuit according to the eleventh embodiment of the present invention includes further a variable resistance $R_R$ between the first node $N_1$ and the output terminal 132 of the reference current output unit I of the ninth embodiment. The sink controller II, includes two voltage terminals: a first voltage terminal $V_1$ connected with a third transistor $T_3$ and a second voltage terminal $V_2$ connected with a fourth transistor $T_4$. The first voltage terminal $V_1$ is set to be a constant value, such as a ground voltage. Alternatively, a positive voltage or a negative voltage can be used as a value of the first voltage terminal $V_1$. Meanwhile, a certain voltage value is respectively applied to the second voltage terminal $V_2$ in accordance with the R/G/B channels. In this case, if the voltage level is controlled, a level of the sink current $I_{sink}$ can be increased or decreased, so that a certain voltage level is transmitted to the data line D/L.

Figure 14:
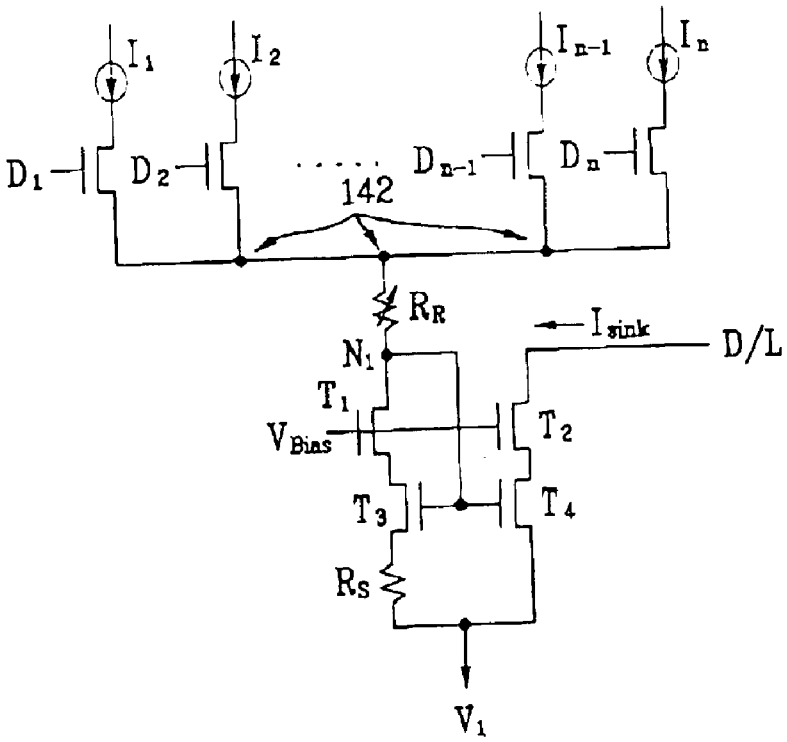
FIG. 14 illustrates a circuit diagram of a driving circuit in an AMELD according to a twelfth embodiment of the present invention.

As shown in FIG. 14, a driving circuit according to the twelfth embodiment of the present invention includes further a variable resistance $R_R$ between the output terminal 142 of the reference current output unit I and a first node $N_1$, and a fixed resistance $R_s$ between a third transistor $T_3$ and a first voltage terminal $V_1$. A value of the fixed resistance $R_s$ is determined according to R/G/B channels. That is, in case that an equal pixel voltage is applied, an amount of current that flows from the data line D/L to the first voltage terminal $V_1$ is determined according to the value of the fixed resistance. Accordingly, it is possible to control the sink current $I_{sink}$ value according to each R/G/B color with an equal digital input signal.

Figure 15:
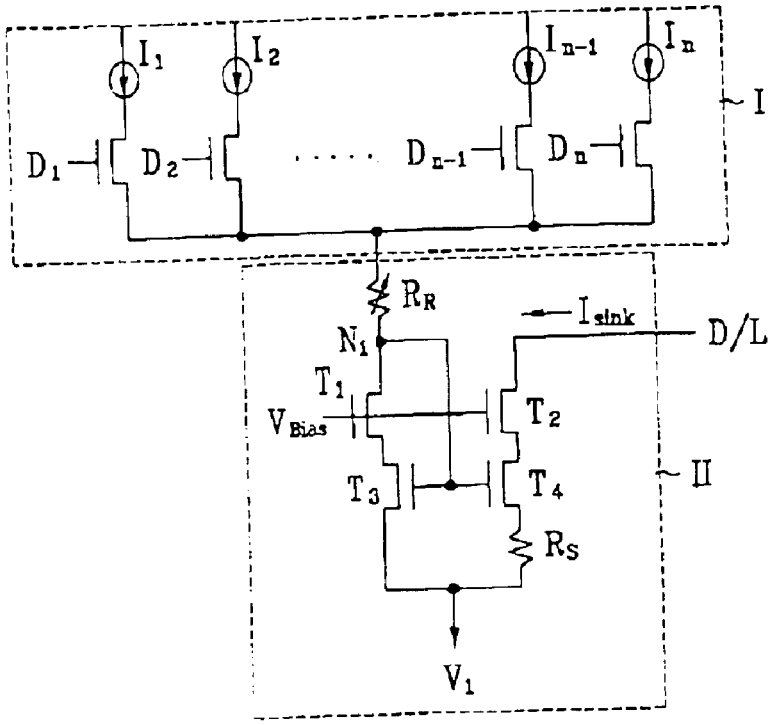
FIG. 15 illustrates a circuit diagram of a driving circuit in an AMELD according to a thirteenth embodiment of the present invention.

In the twelfth embodiment of the present invention, a fixed resistance may be connected between a fourth transistor $T_4$ and a first voltage terminal $V_1$ shown in FIG. 15 of the thirteenth embodiment.

Fourteenth and Fifteenth Embodiments

Figure 16:
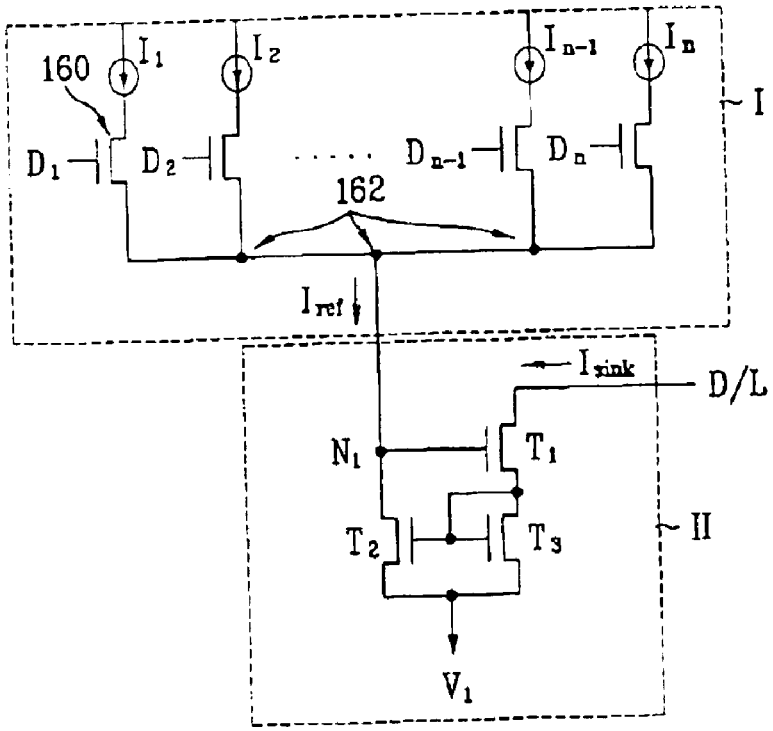
FIG. 16 illustrates a circuit diagram of a driving circuit in an AMELD according to a fourteenth embodiment of the present invention.
Figure 17:
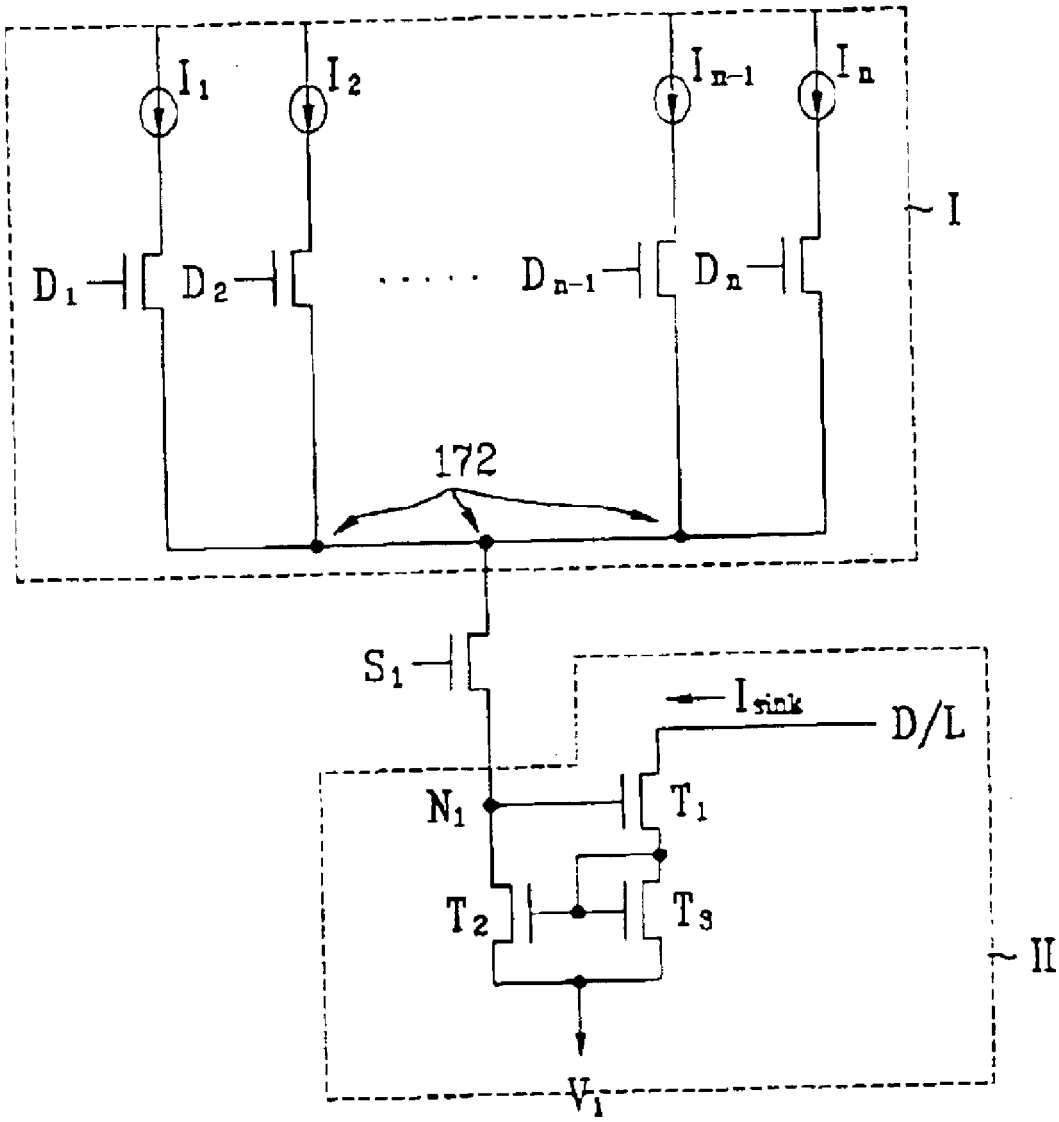
FIG. 17 illustrates a circuit diagram of a driving circuit in an AMELD according to a fifteenth embodiment of the present invention.

FIG. 16 is a circuit diagram of a driving circuit of an AMELD according to the fourteenth embodiment of the present invention. FIG. 17 is a circuit diagram of a driving circuit of an AMELD according to the fifteenth embodiment of the present invention.

As shown in FIG. 16, the AMELD according to the fourteenth embodiment of the present invention includes a reference current output unit I and a sink current controller II. In the sink current controller II, a level of a sink current $I_{sink}$ can be controlled by receiving the reference current $I_{ref}$ output from the reference current output unit I.

At this time, the reference current output unit I includes a plurality of switching devices 160. Various currents $I_1 \ldots I_n$ of different levels are applied to input terminals of the switching devices. Then an output level in output terminals 162, which are connected to one another, is determined by control signals $D_1$ to $D_n$.

In the present embodiment, the switching device is a TFT.

The sink current controller II includes a first voltage terminal $V_1$, and first, second and third transistors $T_1$, $T_2$ and $T_3$.

At this time, the first transistor $T_1$ is directly connected to a data line D/L, and the second transistor $T_2$ is connected between the output terminal 162 of the reference current output unit I and the first voltage terminal $V_1$. The first and third transistors $T_1$ and $T_3$ are connected in series between the data line D/L and the first voltage terminal $V_1$.

Gates of the second and third transistors $T_2$ and $T_3$ are connected to a drain of the first transistor $T_1$. A gate of the first transistor $T_1$ is connected to a first node $N_1$ between the output terminal 162 of the reference current output unit I and the input terminal of the first transistor $T_1$.

In the above structure, a sink current $I_{sink}$ value of each R/G/B channel can be controlled by applying a different voltage in accordance with the R/G/B channels to the first voltage terminal $V_1$ without varying the digital input signal, thereby improving packing density of an IC for driving current.

Meanwhile, as shown in FIG. 17, a driving circuit according to the fifteenth embodiment of the present invention includes further a current breaking switch $S_1$ between the output terminal 172 of the reference current output unit I and a first node $N_1$ of the fourteenth embodiment.

As shown in FIG. 12, in a driving circuit according to the tenth embodiment of the present invention, a current breaking switch $S_1$ is additionally formed between the input terminal of the second transistor $T_2$ and the output terminal 172 of the reference current output unit I of the ninth embodiment of the present invention.

The current breaking switch $S_1$ I of the second, fourth, seventh, tenth and fifteenth embodiments is formed to electrically disconnect the output terminal 172 of the reference current output unit I with the sink current controller II. Also, the current breaking switch $S_1$ is formed to decrease noise generated during turning on or off the switching devices by the $D_1$ to $D_n$ that serve as control signals, so that it is possible to prevent undesired current consumption. (reference to FIGS. 4, 6, 9, 12 and 17)

In the present invention, the noise generated during turning on or off the switching device by the digital input signals of n bits is little, so that it is possible to form the driving circuit without regard for the noise as shown in the first, third, sixth, ninth and fourteenth embodiments of the present invention.

The driving circuit of the AMELD according to the present invention has the following advantages.

First, it is possible to drive the circuit according to each R/G/B channel with an equal digital input signal, thereby improving packing density of the IC for driving current.

Furthermore, the noise is little during turning on or off the digital input signal, so that it is not required to have the switching device for decreasing the noise.

It will be apparent to those skilled in the art than various modifications and variations can be made in the present invention. Thus, it is intended that the present invention covers the modifications and variations of this invention provided they come within the scope of the appended claims and their equivalents.

What is claimed is:

1. A driving circuit for an active matrix electroluminescence device (AMELD) having data and gate drivers that respectively transmit a data signal and a scan signal to each of a plurality of pixel regions, comprising:

a latch for latching a control signal; and a plurality of digital to analog converters (DAC) for outputting a reference current of a certain level as a data signal according to R/G/B channels and the control signal, wherein the DACs include:

a reference current output unit for outputting a reference current, wherein the reference current output unit temporarily combines a plurality of reference current sources of a plurality of switching devices to output the reference current; and a sink current controller for controlling a level of a sink current according to each R/G/B channel by receiving the reference current from the reference current output unit.

2. The driving circuit for an active matrix electroluminescence device as claimed in claim 1, wherein an output terminal of the sink current controller is connected to a data line.

3. The driving circuit for an active matrix electroluminescence device as claimed in claim 1, wherein the control signal is a digital input signal corresponding to a video analog signal.

4. The driving circuit for an active matrix electroluminescence device as claimed in claim 1, wherein the reference current sources are temporarily set to any one of binary weight and gamma correction methods.

5. The driving circuit for an active matrix electroluminescence device as claimed in claim 1, wherein the switching device is a thin film transistor.

6. The driving circuit for an active matrix electroluminescence device as claimed in claim 1, the sink current controller is of a current mirror type including:

a first voltage terminal;

a second voltage terminal;

a first transistor connected between an output terminal of the reference current output unit and the first voltage terminal; and a second transistor connected between the second voltage terminal and a data line, the first and second transistors being controlled by the output terminal of the reference current output unit.

7. The driving circuit for an active matrix electroluminescence device as claimed in claim 6, wherein the first voltage terminal is set at a certain value, and the second voltage terminal controls a level of a sink current according to each R/G/B channel by an externally applied voltage according to each R/G/B channel.

8. The driving circuit for an active matrix electroluminescence device as claimed in claim 6, further comprising a current breaking switch between the output terminal of the reference current output unit and the first transistor.

9. The driving circuit for an active matrix electroluminescence device as claimed in claim 1, wherein the sink current controller includes a first voltage terminal;

a fixed resistance;

a first transistor connected to the fixed resistance in series between an output terminal of the reference current output unit and a first voltage terminal; and a second transistor connected between the first voltage terminal and a data line, the first and second transistors being controlled by the output terminal of the reference current output unit.

10. The driving circuit for an active matrix electroluminescence device as claimed in claim 9, wherein the fixed resistance is connected between the first voltage terminal and the first transistor, the fixed resistance selected according to a certain reference current for each R/G/B channel.

11. The driving circuit for an active matrix electroluminescence device as claimed in claim 9, wherein the first voltage terminal is a constant value.

12. The driving circuit for an active matrix electroluminescence device as claimed in claim 9, further comprising a current breaking switch between the output terminal of the reference current output unit and the first transistor.

13. The driving circuit for an active matrix electroluminescence device as claimed in claim 1, wherein the sink current controller includes a first voltage terminal;

a fixed resistance;

a first transistor connected between an output terminal of the reference current output unit and the first voltage terminal;

and a second transistor connected to the fixed resistance in series between the first voltage terminal and a data line, the first and second transistors being controlled by the output terminal of the reference current output unit.

14. The driving circuit for an active matrix electroluminescence device as claimed in claim 13, wherein the first voltage terminal is a constant value.

15. The driving circuit for an active matrix electroluminescence device as claimed in claim 13, wherein the fixed resistance is connected between the first voltage terminal and the second transistor, the fixed resistance selected according to a certain reference current for each R/G/B channel.

16. The driving circuit for an active matrix electroluminescence device as claimed in claim 13, further comprising a current breaking switch between the output terminal of the reference current output unit and the first transistor.

17. The driving circuit for an active matrix electroluminescence device as claimed in claim 1, wherein the sink current controller includes a first voltage terminal;

first and second transistors;

a third transistor connected with the first transistor in series between an output terminal of the reference current output unit and the first voltage terminal; and a fourth transistor connected with the second transistor in series between the first voltage terminal and a data line, the third and fourth transistors being controlled by the output terminal of the reference current output unit.

18. The driving circuit for an active matrix electroluminescence device as claimed in claim 17, wherein gates of the first and second transistors are connected to a bias voltage.

19. The driving circuit for an active matrix electroluminescence device as claimed in claim 17, wherein the first voltage terminal is an externally applied voltage to control a sink current according to each R/G/B channel.

20. The driving circuit for an active matrix electroluminescence device as claimed in claim 17, wherein the bias voltage is constantly applied from an external source.

21. The driving circuit for an active matrix electroluminescence device as claimed in claim 20, further comprising a current breaking switch between the output terminal of the reference current output unit and the first transistor.

22. The driving circuit for an active matrix electroluminescence device as claimed in claim 17, further comprising a current breaking switch between the output terminal of the reference current output unit and the first transistor.

23. The driving circuit for an active matrix electroluminescence device as claimed in claim 1, wherein the sink current controller includes a first voltage terminal;

a first transistor;

a second transistor connected between the first voltage terminal and the output terminal of the reference current output unit; and a third transistor connected with the first transistor in series between the first voltage terminal and a data line, the second and third transistors being controlled by output value from a drain of the first transistor.

24. The driving circuit for an active matrix electroluminescence device as claimed in claim 23, wherein a gate of the first transistor is connected to the output terminal of the reference current output unit.

25. The driving circuit for an active matrix electroluminescence device as claimed in claim 23, wherein the first voltage terminal applies a certain voltage according to each R/G/B channel.

26. The driving circuit for an active matrix electroluminescence device as claimed in claim 1, wherein the sink current controller includes a first voltage terminal;

a variable resistance and a first transistor connected in series between an output terminal of the reference current output unit and the first voltage terminal;

a third transistor connected in series between the data line and the first voltage terminal;

a gate of the third transistor contacted between the variable resistance and the first transistor; and a second transistor connected in series between the third transistor and the first voltage terminal, gates of the first and second transistors contacting a drain of the third transistor.

27. The driving circuit for an active matrix electroluminescence device as claimed in claim 26, wherein the first voltage terminal applies a certain voltage according to each R/G/B channel.

28. The driving circuit for an active matrix electroluminescence device as claimed in claim 26, wherein a fixed resistance having a certain resistance value according to R/G/B channels is connected between the first transistor and the first voltage terminal.

29. The driving circuit for an active matrix electroluminescence device as claimed in claim 26, wherein a fixed resistance having a certain resistance value according to R/G/B channels is connected between the second transistor and the first voltage terminal.

30. The driving circuit for an active matrix electroluminescence device as claimed in claim 1, wherein the sink current controller includes a first voltage terminal;

a second voltage terminal;

a variable resistance, a first transistor, and a third transistor connected in series between the output terminal of the reference current output unit and the first voltage terminal;

a second transistor connected in series between the data line and the second voltage terminal;

gates of the first and second transistors connected to a bias voltage; and a fourth transistor connected in series between the second transistor and the second voltage terminal;

gates of the third and fourth transistor connected between the variable resistance and the first transistor.

31. The driving circuit for an active matrix electroluminescence device as claimed in claim 30, wherein the bias voltage is constantly applied from an external source.

32. The driving circuit for an active matrix electroluminescence device as claimed in claim 30, wherein the first voltage terminal has a certain value and the second voltage terminal applies a certain voltage from an external source according to R/G/B channels, thereby controlling a level of sink current according to R/G/B channels.

33. The driving circuit for an active matrix electroluminescence device as claimed in claim 1, wherein the sink current controller includes a first voltage terminal;

a variable resistance, a first transistor, and a third transistor connected in series between an output terminal of the reference current output unit and the first voltage terminal;

a second transistor connected in series between a data line and the first voltage terminal;

gates of the first and second transistors connected to a bias voltage; and a fourth transistor connected in series between the second transistor and the first voltage terminal;

gates of the third and fourth transistors connected between the variable resistance and the first transistor.

34. The driving circuit for an active matrix electroluminescence device as claimed in claim 33, wherein a fixed resistance having a certain resistance value according to R/G/B channels is connected between the third transistor and the first voltage terminal.

35. The driving circuit for an active matrix electroluminescence device as claimed in claim 33, wherein a fixed transistor having a certain resistance value according to R/G/B channels is connected between the fourth transistor and the first voltage terminal.

36. The driving circuit for an active matrix electroluminescence device as claimed in claim 33, wherein the first voltage terminal applies a certain voltage from a external source to control a sink current according to R/G/B channels.

* * * * *